United States Patent [19]

Hansen

[11] Patent Number: 4,936,049

[45] Date of Patent: Jun. 26, 1990

[54] AIRTIGHT DOOR

[76] Inventor: Leslie N. Hansen, 528 Saguaro, Washington, Utah 84780

[21] Appl. No.: 372,695

[22] Filed: Jun. 26, 1989

[51] Int. Cl.[5] ..... E05D 15/10

[52] U.S. Cl. ..... 49/209; 49/235; 49/409; 49/475; 49/485

[58] Field of Search ..... 49/409, 411, 415, 420, 49/235, 234, 485, 475, 410, 404, 425, 209; 52/207

[56] References Cited

U.S. PATENT DOCUMENTS

| | | | |
|---|---|---|---|
| 880,865 | 3/1908 | Davis . | |
| 1,250,816 | 12/1917 | Dunderdale | 49/225 |
| 1,902,772 | 3/1933 | Gilpin . | |
| 2,784,444 | 3/1957 | Greig . | |
| 2,858,408 | 10/1958 | Barroero | 49/410 X |
| 2,931,434 | 4/1960 | Steel | 49/485 X |
| 3,075,255 | 1/1963 | Taubman | 49/411 |
| 3,156,020 | 11/1964 | Horgan, Jr. | 49/409 |
| 3,199,155 | 8/1965 | Coleman | 49/409 X |
| 3,276,166 | 10/1966 | Markus | 49/410 |
| 3,276,167 | 10/1966 | Bus et al. | 49/485 |
| 3,583,101 | 6/1971 | Pudenz | 49/420 |
| 3,611,637 | 10/1971 | Saino | 49/235 |
| 3,818,636 | 6/1974 | Calais et al. | 49/235 X |
| 4,404,770 | 9/1983 | Markus | 49/409 X |
| 4,476,652 | 10/1984 | Beauchot | 49/235 |
| 4,754,573 | 7/1988 | Van Rooij et al. | 49/410 X |
| 4,815,246 | 3/1989 | Haas | 49/404 X |

*Primary Examiner*—Philip C. Kannan

*Attorney, Agent, or Firm*—Fleit, Jacobson, Cohn, Price, Holman & Stern

[57] ABSTRACT

An airtight door of the type including at least one sliding panel mounted in a guide track and supported by a plurality of rollers and sealed by a seal structure and provided with a heat wire, tape or strip to establish a frost free seal. The structure disclosed is adapted for use in a door as illustrated and also is adapted for use in sliding windows or similar closures.

6 Claims, 1 Drawing Sheet

AIRTIGHT DOOR

BACKGROUND OF THE INVENTION

1. FIELD OF THE INVENTION

The present invention generally relates to a closure for an opening in a building wall to isolate the interior of the building from environmental conditions outside of the building. More particularly, the present invention relates to an airtight door of the type including at least one sliding panel mounted in a guide track and supported by a plurality of rollers, sealed by a seal structure provided with a resistance type heating wire, tape or strip to establish a frost free seal. The structure disclosed is adapted for use in a door as illustrated and also is adapted for use in sliding windows or similar closures and does not require a track along the bottom of the door or window. The door or window is guided by short guides at the top and bottom of the door or window in the center of the opening and at the center of the sliding travel of the door or window. This enables a smooth threshold to be used which needs no cleaning which is a significant advantage of the invention.

2. INFORMATION DISCLOSURE STATEMENT

Various efforts have been made to provide a substantially airtight closure door or window for openings in a building wall. Weather stripping of various shapes and configurations associated with a movable closure door or window are well-known and have substantially reduced air passage past the door or window. While swinging closure weather stripping is rather effective, sliding doors and windows present additional problems due to increased frictional resistance to movement of a sliding panel which occurs when weather stripping is tightly engaged with the surfaces of a sliding door or window. The following U.S. patents are relevant to this invention but do not disclose the specific structural details.

| | |
|---|---|
| 880,865 | 3,276,166 |
| 1,902,772 | 3,276,167 |
| 2,784,444 | 3,583,101 |
| 2,931,434 | 3,818,636 |

SUMMARY OF THE INVENTION

An object of the present invention is to provide an airtight door including at least one slidable panel supported by an overhead track including horizontal flanges with oppositely facing free edges to receive and rollingly support rollers carried by the slidable panel with the lower edge of the panel being free to adapt to a smooth threshold with the slidable panel being guided by two short guides placed at the center of the top and bottom of the opening which support and guide the slidable panel during reciprocal movement between open and closed positions.

Another object of the invention is to provide an airtight door having a seal associated therewith to substantially preclude passage of air between the seal and door when the door is in closed position.

A further object of the invention is to provide an airtight door in accordance with the preceding objects in which a heating wire, tape or strip is associated with the seal to provide a frost free seal when the electric resistance type heating wire, tape or strip is energized thereby facilitating operation of the door even though the door may be subjected to cold and inclement weather conditions.

Still another object of the invention is to provide an airtight door in accordance with the preceding objects in which the overhead supporting track flanges are provided with recesses which receive the rollers when the door is in closed position thereby enabling the bottom of the door to drop into engagement with the threshold to form a positive and sealed engagement between the bottom of the sliding door and the threshold with the rollers being rotatably supported by ball bearings to facilitate movement of the sliding door with minimum effort.

A still further object of the invention is to provide an airtight door in which the door includes laterally adjustable guide members in the form of button-shaped bumps engageable with short guides at the center of the top and bottom of the sliding door to maintain the sliding door in substantially vertical position during sliding movement and retain the sliding door and seals in sealed relation to the frame when in closed position.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
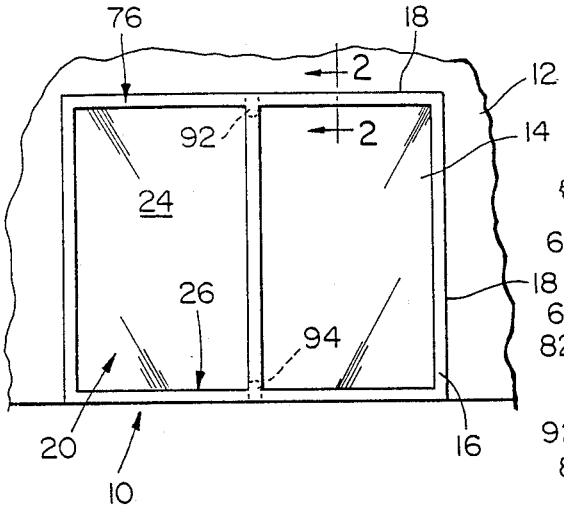
FIG. 1 is an elevational view illustrating a typical sliding door installation including a stationary panel and a sliding panel movable between an open position overlying the stationary panel and a closed position in which one edge of the movable door overlaps a free edge of the stationary door panel with the top and bottom center guides being shown.

Referring now specifically to the drawings, the airtight door of the present invention is generally designated by reference numeral 10 and is illustrated as being installed in a building wall 12 and including a stationary transparent panel 14 having a peripheral frame 16 that is rigidly fixed in the building wall opening 18 in a conventional and well-known manner. The airtight door 10 also includes a horizontally slidable movable door panel generally designated by reference numeral 20 and which is movable between a closed position as illustrated in FIG. 1 to an open position in which the movable door panel is positioned in parallel overlapping relation to the stationary door panel 14.

The movable door panel 20 includes a pair of transparent panels 22 and 24 disposed in spaced relation and sealed to a peripheral frame 26 by a gasket or sealant 28 in a manner well-known in this art. While a double glazed door has been disclosed, the invention can be incorporated into any type of sliding door, window or closure panel constructed of various materials including but not limited to wood, plastic, metal and combinations thereof. The frame 26 is generally provided with inwardly extending flanges 30 which retain the gasket or sealant in place. Also, the frame 26 includes a peripheral wall or web 32 that is peripherally continuous and forms a backing for the gasket or sealant 28 completely around the periphery of the transparent panels 22 and 24. The bottom of the frame 26 is inclined as at 34 to parallel the inclined upper surface 36 of a threshold 38 and the flanges 40 and gasket or sealant 42 along the bottom of the movable door panel 20 may have more vertical depth than the top and sides of the frame and gasket since the bottom of the door will have rain, ice and snow deposited thereon.

Figure 2:
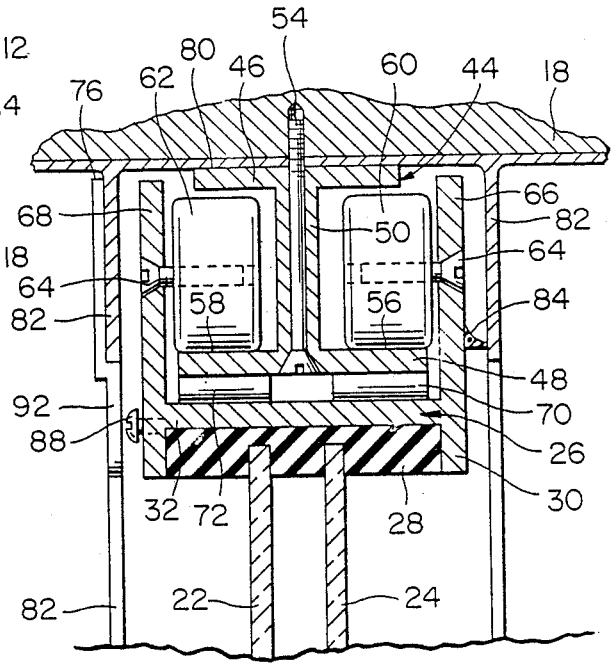
FIG. 2 is a vertical, sectional view, on an enlarged scale taken along section line 2—2 on FIG. 1 illustrating the structure of the supporting track, a center guide and door frame structure.
Figure 4:
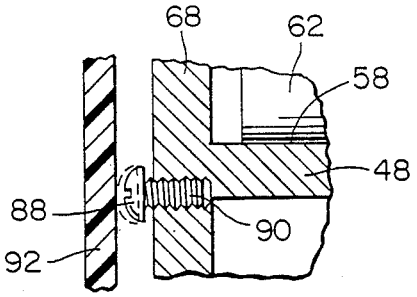
FIG. 4 is a fragmental, sectional view illustrating one of the adjustable bumps mounted on the door.
Figure 5:
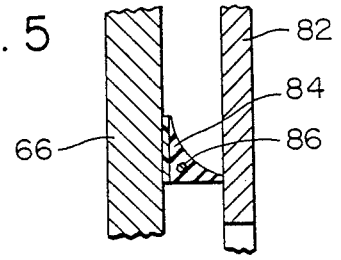
FIG 5 is a fragmental, sectional view illustrating the seal structure.
Figure 6:
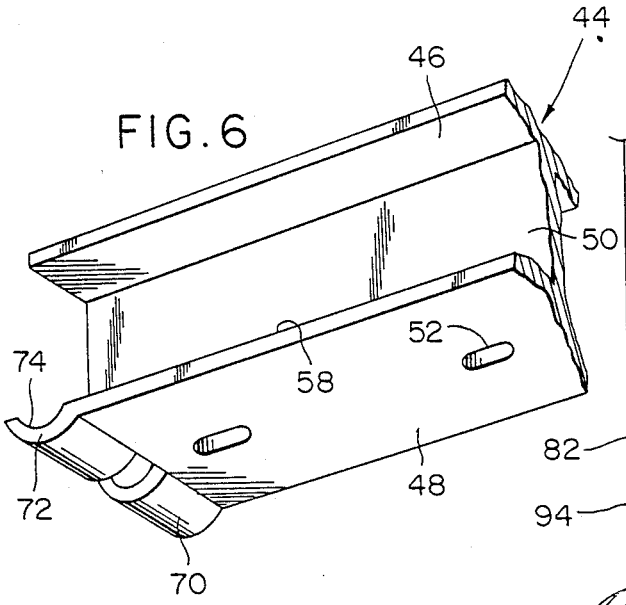
FIG. 6 is a fragmental, perspective view illustrating an end portion of the supporting track illustrating the partially cylindrical recesses formed in the track flanges.
Figure 3:
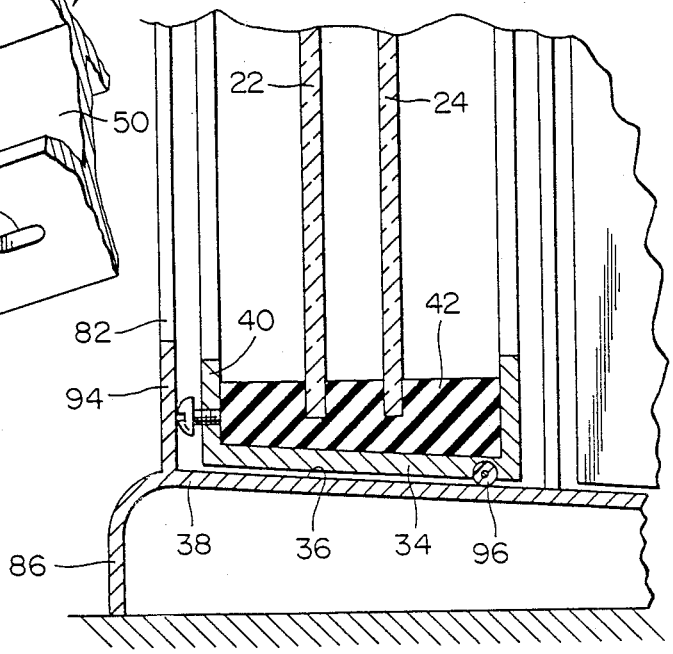
FIG. 3 is a sectional view, on an enlarged scale, illustrating the bottom of the door, the seal, the guide and threshold structure.

The movable door panel 20 is supported from an overhead track generally designated by reference numeral 44 and is generally in the form of an I-beam including an upper flange 46 and a lower flange 48 interconnected by a centrally disposed vertical web 50. The track 40 includes centrally disposed apertures 52 which are horizontally elongated to form slots for receiving anchor bolts or fasteners 54 which extend into the upper periphery of the opening 18 as illustrated in FIG. 2 with the bolts or screws 54 being countersunk to provide a smooth bottom surface to the track 44. The track 44 thus includes a pair of generally parallel upwardly facing track flange surfaces 56 and 58 which are rollingly engaged by support rollers 60 and 62 journalled on axles, fastening pins, bolts or the like 64 secured to upwardly extending flanges 66 and 68 which are integral with the flanges 30 forming a portion of the frame 26. Thus, the rollers 60 and 62 are mounted from the frame 26 and are rollingly supported from the bottom flange 48 of the track 44. The track 44 extends throughout the width of the opening 18 so that the movable door panel 20 can move from its closed position as illustrated in FIG. 1 to its open position in alignment with the stationary door panel 14.

The bottom flange of the track 44 includes detents 70 and 72 formed therein, each of which forms an upwardly facing partially cylindrical recessed surface 74 which conforms with and receives the periphery of the rollers 60 and 62 when the door is in the open and closed position. The door is provided with a set of rollers 60 and 62 at the top corners thereof with the track flange surfaces 56 and 58 each being provided with three longitudinally spaced recessed surfaces 74 with one pair of recesses at each end of the track 44 and one generally in the center so that when the movable door panel 20 is in the open position, the rollers will drop downwardly into and be retained in the recessed surfaces 74 at one end and at the center of the track 44 and when the movable door panel 20 is closed, the rollers will be engaged with the other set of end recessed surfaces 74 and the centrally disposed recessed surfaces 74 thereby maintaining the door in both open and closed position and permitting the movable door panel 20 to drop slightly when in its fully open and fully closed position.

The opening 18 is defined by an upper frame member 76 and two side frame members 78 and the threshold 38 with the upper surface of the threshold being smooth and inclined at 36 and each of the frame members 76 and 78 including a web 80 and four parallel inwardly extending flanges 82 integral therewith to receive a screen (not shown), the stationary door panel 14 and the movable door panel 20 as illustrated in FIG. 2 with the movable door panel being disposed inwardly of the stationary door panel and supported by the track 44 and the rollers 60 and 62. The outwardly disposed flange 66 forming part of the frame 26 for the door 20 includes a seal 84 of resilient material such as rubber or the like mounted thereon with the seal 84 including a resistance wire heating element 86 therein. The seal extends peripherally of the frame 26 and is secured thereto by adhesive bonding or by a mechanical attaching device. The inner flange 68 on the frame 26 includes button-shaped bumps or guide members 88 that are adjustably mounted on the flange 68 by a screw threaded stud 90 with the buttons being located adjacent the web 32 of the frame 26. The movable door includes four button-shaped bumps or guides 88 with one bump 88 being disposed on each inside corner of the door with the two buttons on the leading edge of the movable door engaging the innermost flange 82 on the side frame 78 and the two bumps on the side edge of the movable door which overlaps the stationary door panel 14 engaging and cooperating with a pair of guide members 92 and 94 mounted at the center of the top frame 76 and threshold 38 with the guide members 92 and 94 being in the form of extensions on the innermost flange 82 on the top frame 76 and the inner edge portion of the threshold 38. Thus, when the movable door 20 is closed, the rollers 60 and 62 will drop into the recesses 74 and the button-shaped bumpers 88 will engage the guide members 92 and 94 and the inner surface of the flange 82 on the frame 78 adjacent the free edge of the movable door 20 and cause the door 20 to be moved slightly laterally to urge the seal 84 into sealing contact with the flange 82 that is closest to the flange 66 on the frame 26 which extends peripherally of the door. When the rollers 60 and 62 drop into the recessed surfaces 74, a bottom seal 96 having a heating wire therein will sealingly engage the upper surface 36 of the threshold 38. The resistance heating wire 86 may be connected to a plug to enable the heating wire to be plugged into an electrical outlet during periods of low temperature.

This invention solves a long existing problem associated with the upkeep and maintenance of patio sliding doors and screens in which the threshold and supporting rollers frequently collect strings, hair, dirt and other foreign materials. Another problem which has existed is the seal normally provided on sliding patio doors providing frictional resistance to movement of the sliding door panel thereby requiring considerable force to open and close the door. Also, in periods of cold weather, the movable door panel frequently will be inoperative because of accumulation of ice, especially between the threshold track and bottom edge of the door.

The present invention corrects these problems by hanging the door from the top of the frame thereby permitting a smooth and clean threshold surface and the rollers would be free from strings, hair and other foreign material. By providing the detents or recesses 74 in the overhead track, the door 20 will drop down and seal by gravity to the threshold when the rollers on the door match the recesses and thus move downwardly into the recesses when the door is moved to a closed position. The overhead track is slightly shorter than the top frame 76 with the slot-like openings 52 enabling adjustment of the track horizontally a short distance to make sure that the rollers and recessed surfaces will register properly and actually enable the vertical movement of the door to be adjusted since horizontal movement of the door will be limited by its engagement with the side frame member 78.

In order to seal the top and two sides of the door, the four adjustable bumps 88 are mounted on the inside of the frame 26 of the sliding door 20 with these bumps engaging the side frame 78 on the side of the opening which receives the free edge of the door and the center guides 92 and 94 when the door is completely closed with the bumps tightening the seal against the top frame 76, the side frame 78 and the fixed or stationary door panel 14. Immediately when the sliding door starts to move from the closed toward the open position, the pressure exerted by the bumps is instantly released and the rollers would rise from the recessed surfaces or detents 74 thus leaving the sliding door freely movable. The two center guides are placed in the center of the opening, one at the top and one at the bottom, with the top guide member 92 being fastened to the top frame 76 with its only function being to receive the adjustable bump. The lower guide 94 is heavier and is fastened to the threshold and the floor of the house with it also functioning to receive the adjustable bump and also to hold the door in at the bottom. The guides 92 and 94 are preferably constructed of nylon, other plastic material or any other material strong enough to meet the requirements of building codes and to perform the desired function. The problem of freezing is alleviated by the heating wire incorporated into the seal around the outside of the sliding door with the seal touching all points necessary to shut out air when the door is closed. The heating wire is energized by connection to an electrical outlet and may be provided with a conventional male plug. The four bumps or guide members 88 that are placed on the inside of the sliding door simultaneously engage with the top and bottom of the frame 26 by engaging the flange 82 on the side frame member 78 at the edge of the opening which receives the free edge of the sliding door 20. Simultaneously, the bumps engage the center guides 92 and 94 as the door closes. Also, as the door closes, the rollers drop into the recess surfaces 74 which enables the sliding door panel to drop downwardly a slight distance and by adjusting the overhead track horizontally, the rollers may be oriented in relation to the track to be positioned on the downwardly inclined surface of the recess surfaces 74 thus serving to cam the door 20 to a fully closed position. When the door is opened, the door is immediately lifted and the bumps give the door and seal a slight clearance since they leave the frame 26 at one side of the door and the two center guides at the other side of the door thereby enabling the door to move on the rollers with minimum friction or drag with the guides having bevelled edges and being made of a nylon or other plastic material to further reduce friction.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A closure assembly for a building wall opening comprising a stationary closure panel and a slidable closure panel of substantially the same size with the slidable closure panel being movable between an open position in coinciding, side-by-side aligned relation with the stationary panel and a closed position with the slidable panel extending from one side edge of the stationary panel to close the wall opening, an overhead supporting track for the slidable closure panel, said track comprising a pair of adjacent, upwardly facing horizontal flanges, said slidable closure panel including a peripheral frame with a pair of rollers mounted from each end of the top portion of the frame with the rollers supportingly engaged by the track flanges, each of said track flanges including a plurality of longitudinally spaced upwardly opening recesses to receive the rollers when the slidable panel is in the open and closed position to permit the slidable panel to lower itself by gravity when the rollers are aligned with and received in the track flange recesses to provide a positive closed and open position for the slidable panel, the opening in the building wall including a top frame member, two side frame members perpendicular in relation thereto and a bottom threshold, said threshold having a smooth inclined top surface inclining downwardly and outwardly to direct water toward the outside of the threshold, the inside center of the top frame member and the inside center of the threshold having an inwardly projecting guide member to hold the slidable closure panel vertical as it moves between open and closed positions, a peripheral seal mounted on the outside vertical surface of the top and side edges of the peripheral frame of the slidable panel, said top and side frame members defining the wall opening including flanges disposed in opposed relation to the seal for engagement by the seal when the door is in closed position, the inside vertical surface of the slidable panel including a rounded bump, said bump being formed on the end of a screw threadedly adjustable member mounted on the inside surface of the corners of the peripheral frame of the slidable panel with the bumps engaging the guide members and the side frame member defining the opening to move the slidable panel laterally toward the outside for engaging the seal with the top and side frame members when the slidable panel is moved to a closed position.

2. The structure as defined in claim 1 wherein said seal includes a resistance heating wire embedded therein for connection with a source of electrical energy to prevent accumulation of ice on the sliding door panel and frame during cold weather.

3. A sliding door comprising an overhead track, a door suspended from said track, said door including rollers at the top edge thereof supportingly engaging said track for horizontal movement between open and closed positions, recess means on said track to receive the rollers when the door is in closed position to enable the door to drop downwardly, a threshold underlying the bottom surface of the door and engaged by the door when the door is in closed position with movement of the door toward open position causing the rollers to move out of the recess means to elevate the door thereby disengaging the bottom surface of the door from the threshold thereby reducing frictional drag during movement, a seal on the bottom surface of the door for sealing engagement with the threshold when the door is in closed position, a seal on the outside surface of the door, a door frame including inwardly extending inner and outer flanges with the outer flanges in opposed relation to the seal on the outer surface of the door and means on the inside of the door engaging said inner flanges when the door is moved to a closed position to move the door laterally outwardly to engage the seal on the outer surface of the door with the outer flanges to form a peripheral seal around the door.

4. The structure as defined in claim 3 wherein said means on the door engaging the inner flanges includes a threaded adjustable member having a rounded outer surface mounted on the door with the rounded surfaces engaging the inner flanges to retain the seal on the outer surfaces of the door in sealing engagement with the outer flanges on the door frame.

5. The structure as defined in claim 4 wherein said seal on the bottom surface of the door and said seal on the outer surface of the door includes a resistance heating wire embedded therein for connection with a source of electrical energy to prevent accumulation of ice on the sliding door.

6. The structure as defined in claim 5 wherein said threshold includes a substantially smooth, inclined upper surface with the upper surface of the threshold inclining downwardly and outwardly and being substantially completely smooth from the inner surface of the door to assure that any moisture dripping off the bottom surface of the door will move down the upper surface of the threshold and be discharged externally of the threshold.

* * * * *